United States Patent [19]

Sofinowski, III

[11] 4,107,862

[45] Aug. 22, 1978

[54] CARTRIDGE MAGAZINE

[75] Inventor: Jacob Sofinowski, III, Baldwin, Md.

[73] Assignee: AAI Corporation, Cockeysville, Md.

[21] Appl. No.: 742,304

[22] Filed: Nov. 16, 1976

[51] Int. Cl.[2] ..... F41C 25/02

[52] U.S. Cl. ..... 42/50

[58] Field of Search ..... 42/50

[56] References Cited

U.S. PATENT DOCUMENTS

| | | | |
|---|---|---|---|
| 2,715,789 | 8/1955 | Garand | 42/50 |
| 3,087,270 | 4/1963 | Stoner | 42/50 |
| 3,273,275 | 9/1966 | Badali | 42/50 |
| 3,383,790 | 5/1968 | Into | 42/50 |
| 3,453,762 | 7/1969 | Fremont | 42/50 |

FOREIGN PATENT DOCUMENTS

| | | | |
|---|---|---|---|
| 651,024 | 10/1937 | Fed. Rep. of Germany | 42/50 |
| 875,222 | 8/1961 | United Kingdom | 42/50 |

*Primary Examiner*—Charles T. Jordan

*Attorney, Agent, or Firm*—Reginald F. Pippin, Jr.

[57] ABSTRACT

A cartridge magazine having a slidably removable bottom cover which slides on a pair of flange slide rails on the bottom end of the hollow main cartridge-holding body of the magazine, to enable assembly and removal of the cover. Cam stops and end stops are formed on elastically flexible opposite side walls of the body, and are engagable in releasable locking relation by inturned lock lips which ride in sliding relation on the flange slide rails. The lock lip means are movable over the cam lock stops by depression of the flexible outer walls during assembly and removal of the cover, being cam depressed during assembly and being positively manually depressed for disassembly removal. A cartridge feed spring acts in conjunction with the curvature of the main body and a key tab on the bottom cover to exert a small removal-acting lateral force on the cover.

5 Claims, 6 Drawing Figures

CARTRIDGE MAGAZINE

This invention relates to a cartridge magazine.

A major feature of the invention is the provision of a cartridge magazine with a slidably removable bottom or other end cover which is releasably locked in place through lock stop means selectively releasable by manually depressing the respective elastically flexible side wall or walls of the cartridge main body, with a further feature lying in the provision of cam means on the lock stop means and/or the cover to enable automatic cam acting side wall depression during assembly of the cover onto the body whereby the cover easily slides into locked assembled relation on the main body after insertion of the feed spring and cartridge feed plate.

According to a still further feature the slidable cover in a preferred embodiment is resiliently biased in a lateral sliding removal direction by the feed spring within the main body of the magazine, to aid in removal of the cover.

Still other objects, features and attendant advantages will become apparent from a reading of the following detailed description of a preferred embodiment taken in conjunction with the accompanying drawings, wherein.

Figure 1:
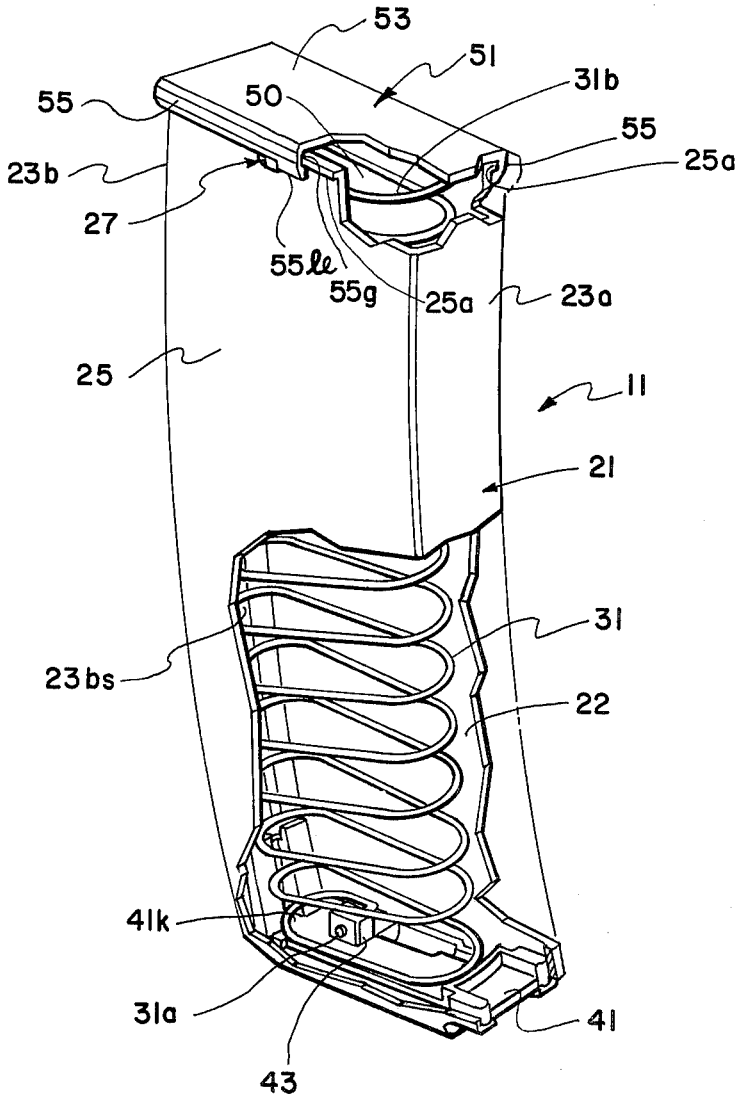
FIG. 1 is a perspective view of a cartridge magazine embodiment according to the invention, the magazine being partially broken away for clarity of illustration.

Referring now in detail to the Figures of the drawings, a cartridge magazine 11 is formed in any suitable manner as, preferably, by injection plastic molding of glass fiber-filled resin, and includes a hollow main body 21 which is preferably curved along its length to accommodate packing of cartridges therein which normally have a smaller tapered front end cross-section than the rear end thereof. However, the main body may also be straight to accommodate other cartridge configurations. A compression feed spring 31 extends along the hollow cartridge holding interior chamber of the main body 21, and is anchored at its normally upper end 31*a* to a vertically or longitudinally slidable cartridge feed plate 41, as through the medium of an anchor block 43 on the facing side of the feed plate, as shown in FIG. 1.

The main body 21 is provided with a concave curved forward wall 23*a* and a convex curved rear wall 23*b*, the rear wall having a vertical movement rear guide channel 23*bs* formed therealong, for accommodation of a weapon assembly actuating key 41*k* on the rear of the feed plate 41.

The feed plate 41 is longitudinally slidable within the cartridge holding chamber formed between respective walls 23*a*, 25, 23*b*, 25 which form the longitudinal extent of the hollow main body 21. The hollow main cartridge holding body 21 is open at its opposite ends, forming respectively an entrance loading end opening 50 for the spring 31 and feed plate 41, and a cartridge exit feed end opening 40. The cartridge feed end opening 40 is bounded on its two lateral sides by inturned retention and guiding lips 25*b*, which serve to retain and guide the exiting cartridges C to a desired centered feed exit position, as well as serving to retain the slidable feed plate 41 within the hollow main body 21 at the end of its travel.

Figure 2:
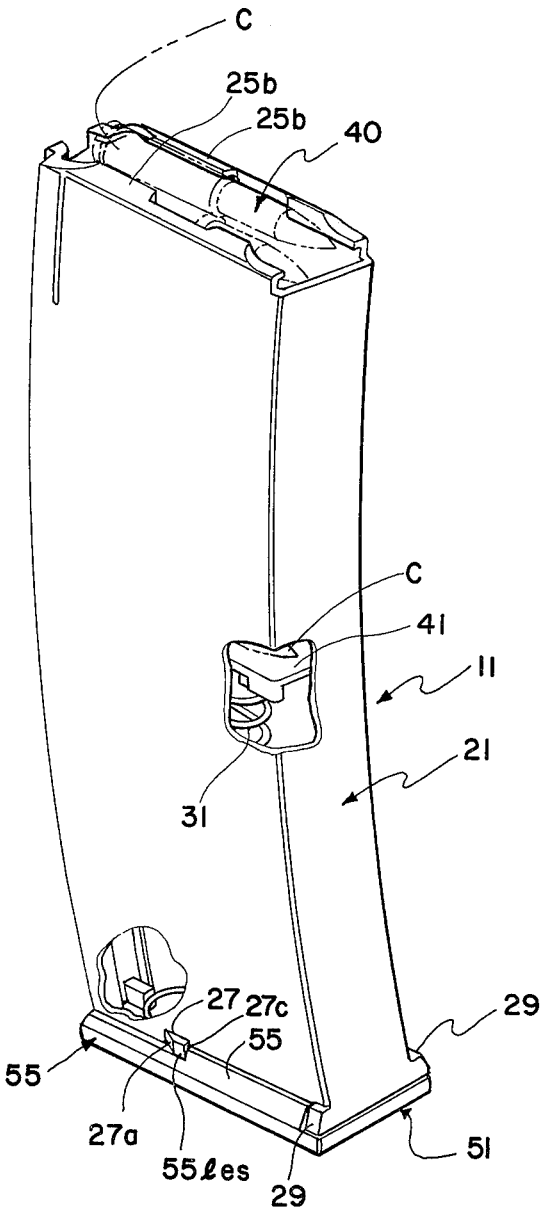
FIG. 2 is a perspective view of the cartridge magazine of FIG. 1, partially loaded with the magazine inverted to its usual upright feed position.
Figure 3:
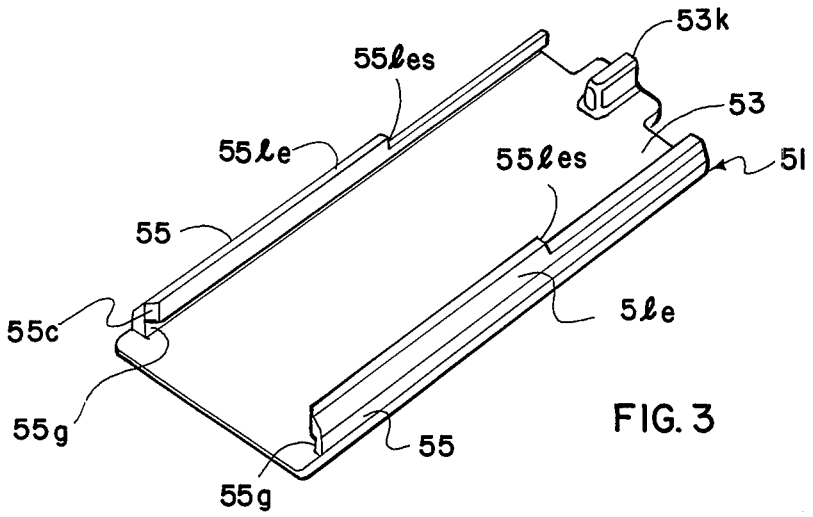
FIG. 3 is a perspective view as viewed from the inner side thereof, of the slidable bottom cover of the magazine of FIG. 1.
Figure 4:
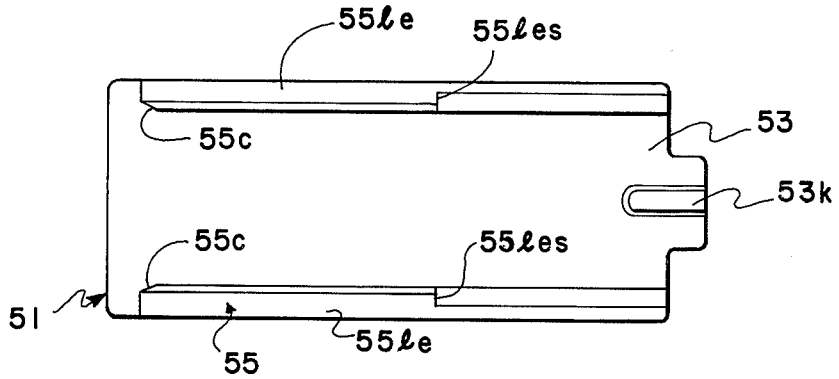
FIG. 4 is a plan view as viewed from the inside of the bottom cover.

A slidable bottom cover 51 is slidably removably secured onto the opposite open end of the magazine body 21 through the medium of slide/retention lips 55 formed thereon, which slidably engage with outwardly oppositely extending slide/retention flange rails 25*a* formed on the respective ends of the side walls 25 of the hollow main body 21. Each of the slide/retention lips 55 is provided with a respective slide/retention lip extension 55*le* which is adapted to slide in camming relation over a respective lock stop 27, which is preferably in the form of a cam lock stop as shown, formed on the respective side wall 25 of the hollow main body 21. When in the secured position as shown in FIGS. 1 and 2, the lock lip extension 55*le* is held in locked retention position by interengagement by its opposite ends with respectively a shoulder stop 27*c* formed on the cam lock stop 27 and an end stop 29 formed on the respective side wall 25 of the hollow main body 21.

The slidable bottom cover 51 may be provided with a spring holding and lateral biasing key 53*k* formed on the inner facing surface of its generally flat central section 53, which biases and maintains the feed spring 31 laterally to a desired curved configuration for proper feeding action of cartridges by the spring 31 and the associated feed plate 41 attached thereto, into the using firearm.

Figure 5:
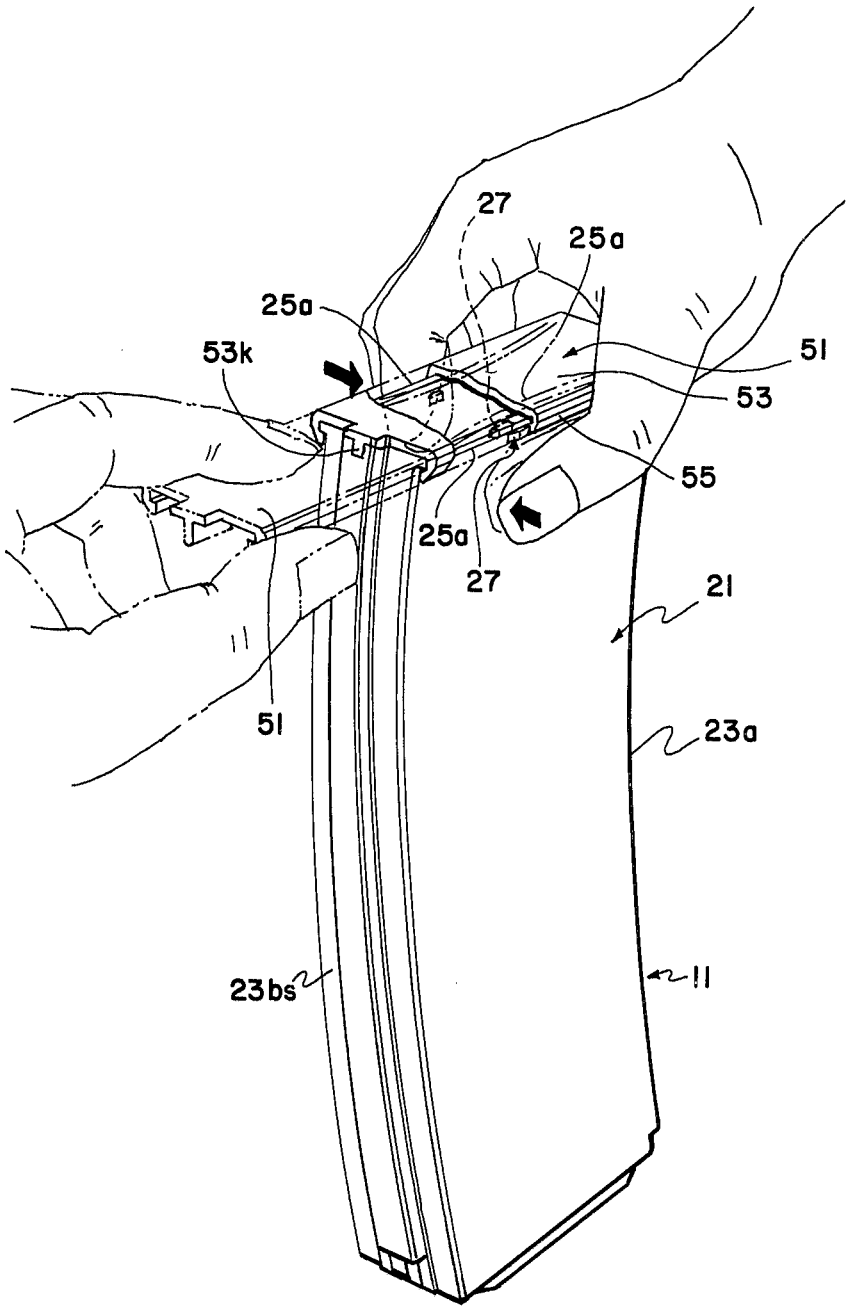
FIG. 5 is a perspective view illustrating assembly and disassembly of the magazine cover.
Figure 6:
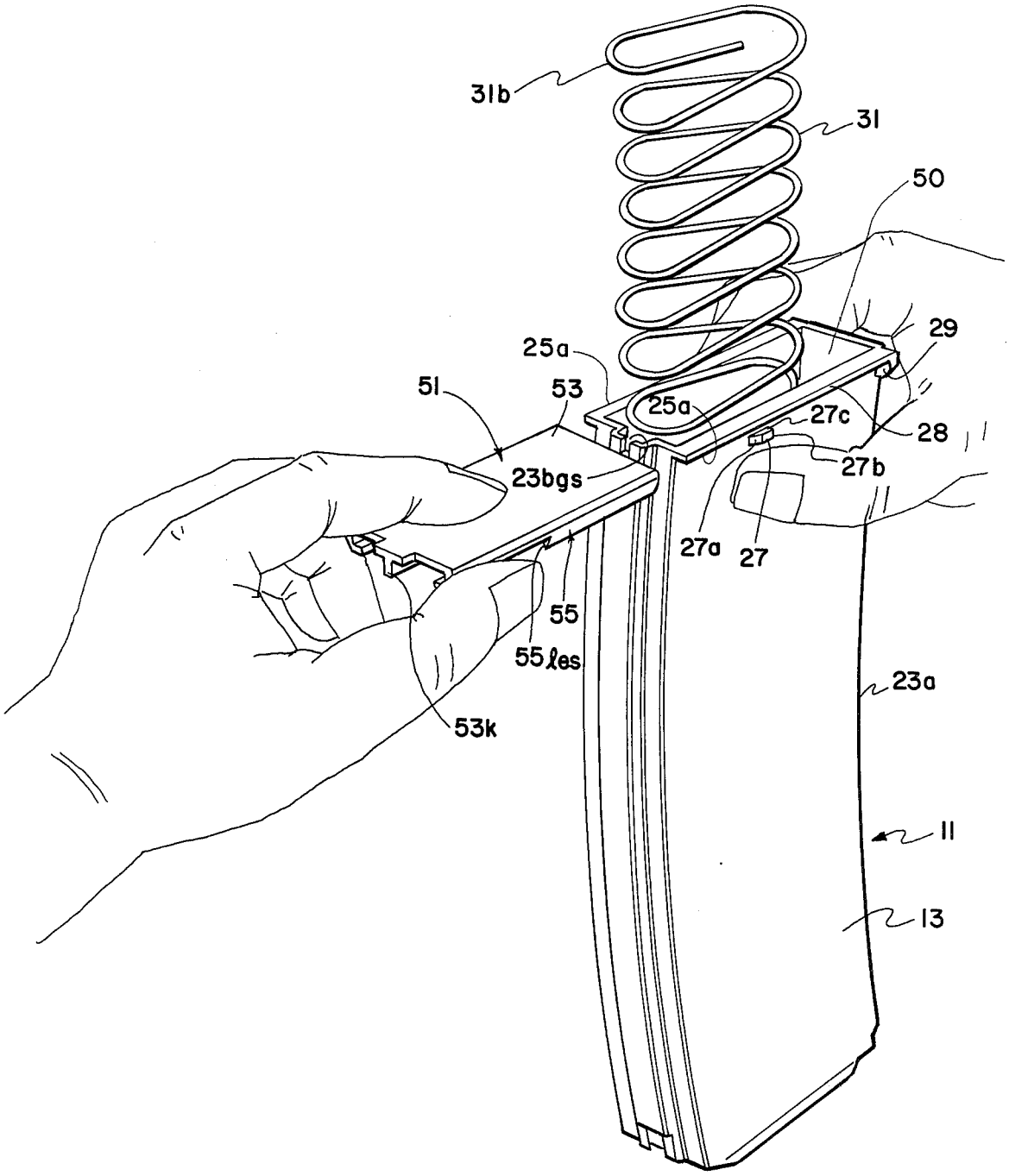
FIG. 6 is a further perspective view illustrating the portion of the magazine main body and cover preparatory to slide on assembly, and also conversely illustrating a similar position of these parts after disassembly removal of the cover.

In order to enable assembly and disassembly of the slidable bottom cover 51 onto and from the slide/retention flange rails 25*a*, the opposite side walls 25 of the hollow main body 21 are formed of material and thickness having a sufficient elastic flexiblity to enable manual elastic flexing depressing thereof by gripping therebetween with a human hand. This may readily be accomplished by molding the hollow main body from conventional plastic materials, such as glass fiber-filled nylon, polycarbonate or ABS (acrylonitrile butadiene styrene), etc. with a wall thickness of the order of 1/16-inch or so, although this thickness is not at all critical and is only for illustrative purposes. By so forming the side walls to enable ease of manual elastic flexing toward one another, while still providing the desired rigidity for normal handling and operation of the magazine, the slidable bottom cover 51 may be readily assembled and removed, as depression of the cam lock stop 27 inwardly sufficient to enable the passage thereover of the lock lip extension 55*le* will be readily accomplished by manual depression of the side walls 25 in the vicinity of slidable bottom cover 51, as generally illustrated in FIG. 5.

While the cover 51 may also be assembled in this same manner, it is desirable that the cover by assembled without necessity for manual release of the cam lock stop 27. To this end, the cam lock stops 27 and/or the entry ends of the lock lip extensions 51*le* are provided with an inclined plane cam entry surface, 27*a* and 55*c* respectively, on the entrance side thereof for engagement by the lock lip extension 55*le* during slide-on assembly of the slidable bottom cover 51 on the rails 25*a*. With this arrangement, the lock lip extensions 55*le* will cam themselves past the cam lock stops 27 by the inclined plane of cam action between the adjoining entry surfaces 55*c* and 27*a* of the lock lip extensions 55*le* and the lock stops 27, resulting in cam interacting automatic lateral depression of the elastically flexible side walls 25 toward one another during the assembly of the slidable bottom cover 51 into locking relation onto the slide/retention rails 25*a*. Removal of the slidable bottom cover 51 may be accomplished as previously discussed, simply by grasping the side walls 25 adjacent the slidable bottom cover 51 and inserting a compressing action thereon, while exerting a slidably removable force on the bottom cover 51, the lock lip extensions 55*le* being thus moved past the cam lock stop 27 while the elastically flexible wide walls are positively depressed inwardly by manual compressive action.

It will be further noted that the compression feed spring 31 is constrained in a curved path, whereas its desired unstressed longitudinal envelope configuration extends in a straight band, the curved path constraint being effected by the curved configuration of the constraining walls 25, 25, 23*a*, 23*b* of the hollow main body 21 and the lateral displacement and constraint imposed by the key tab 53*k* when the bottom cover 21 is slidably locked into place. Thus, the compression feed spring 31 not only acts in a longitudinally compressive cartridge feed action on the vertically slidable feed plate 41 for the purpose of feeding cartridges to the exit end opening 40, but also secondarily serves in the illustrative embodiment to exert a small lateral removal force on the slidable bottom cover 51, which acts in a track against the cam lock stops 27. As a result of this relatively small spring biased removal force by the compression feed spring 41 on the slidable bottom cover 51, manual depression of the elastically flexible side walls 25 adjacent the slidable bottom cover 51 and lock stops 27 will enable the slidable bottom cover 51 to be automatically moved in a sliding fashion on the rails 25*a*, with the lock lip extensions 55*le* moving over and past the lock stop 27, whereby manual removal of the slidable bottom cover may easily be effected. This arrangement thus forms an optional aid to ease of removal of the bottom cover 51.

While the invention has been illustrated and described with respect to a single illustrative preferred embodiment, it will be apparent to those skilled in the art that various changes and modifications may be made without departing from the scope and spirit of the invention. Accordingly, the invention is not to be limited by the particular illustrative embodiment, but only by the scope of the appended claims.

I claim:

1. A cartridge magazine comprising a main body having a cartridge receiving and holding chamber formed therein and open at two opposite ends, one of said open ends forming a cartridge entry and exit feed opening, and the other of said open ends forming a feed spring and feed plate assembly opening, a cartridge feed member slidable in feeding relation within said chamber, a cover removably secured to said main body in a position over said spring and feed plate assembly opening, and a compression feed spring disposed within said chamber and extending in compression biasing relation between said cover and said feed plate, said cover being laterally slidably removable from said main body, said main body having outwardly oppositely extending slide/retention rails formed at opposite sides of said feed spring and feed plate assembly opening, said cover having inturned slide/retention lips with associated slide/retention grooves slidably engagable with said rails for slidably removable retention of said cover over said feed spring and feed plate assembly opening, lock stop means formed on at least one outer side wall of said main body adjacent at least one of said rails, and lock lip means formed on at least one of said slide/retention lips and engagable with said lock stop means to lock said cover in place, said one outer side wall being manually elastically flexible to an extent to enable depression of said lock stop means to a laterally inward position out of locking relation with said lock lip means, said lock stop means being cam lock stop means having a cam entry portion engagable by said lock lip means to enable ease of slide locking of said cover into place on said rails, and a shoulder lock stop retention portion to lock said lock lip means in place after sliding over said cam entry portion, said lock stop means and said lock lip means comprising respective lock stop means and lock lip means on opposite respective sides of said main body and said cover, and both associated outer side walls of said main cover being manually elastically flexible to an extent to enable depression of the respective said lock stop means to a laterally inward position out of locking relation with the respective said lock stop means, a central lateral spring biasing and constraining key tab formed on said cover and engagable in lateral biasing and displacing relation with said spring as a function of slide-on assembly and locking of said cover into place on said rails, and a key tab slot formed in an associated end wall of said main body for passage therethrough of said key tab during assembly and disassembly movement of said cover along said rails.

2. A cartridge magazine comprising a main body having a cartridge receiving and holding chamber formed therein and open at two opposite ends, one of said open ends forming a cartridge entry and exit feed opening, and the other of said open ends forming a feed spring and feed plate assembly opening, a cartridge feed member slidable in feeding relation within said chamber, a cover removably secured to said main body in a position over said spring and feed plate assembly opening, and a compression feed spring disposed within said chamber and extending in compression biasing relation between said cover and said feed plate, said cover being laterally slidably removable from said main body, said main body having outwardly oppositely extending slide/retention rails formed at opposite sides of said feed spring and feed plate assembly opening, said cover having inturned slide/retention lips with associated slide/retention grooves slidably engagable with said rails for slidably removable retention of said cover over said feed spring and feed plate assembly opening, lock stop means formed on at least one outer side wall of said main body adjacent at least one of said rails, and lock lip means formed on at least one of said slide/retention lips and engagable with said lock stop means to lock said cover in place, said one outer side wall being manually elastically flexible to an extent to enable depression of said lock stop means to a laterally inward position out of locking relation with said lock lip means, said lock stop means and said lock lip means comprising respective lock stop means and lock lip means on opposite respective sides of said main body and said cover, and both associated outer side walls of said cover being manually elastically flexible to an extent to enable depression of the respective said lock stop means to a laterally inward position out of locking relation with the respective said lock stop means, a central guide key formed on said cover, and a guide key slot formed in an associated end wall of said main body and slidably engagable by said guide key during assembly and disassembly movement of said cover along said rails.

3. A cartridge magazine comprising a main body having a cartridge receiving and holding chamber formed therein and open at two opposite ends, one of said open ends forming a cartridge entry and exit feed opening, and the other of said open ends forming a feed spring and feed plate assembly opening, a cartridge feed member slidable in feeding relation within said chamber, a cover removably secured to said main body in a position over said spring and feed plate assembly opening, and a compression feed spring disposed within said chamber and extending in compression biasing relation between said cover and said feed plate, said cover being laterally slidably removable from said main body, said main body having outwardly oppositely extending slide/retention rails formed at opposite sides of said feed spring and feed plate assembly opening, said cover having inturned slide/retention lips with associated slide/retention grooves slidably engagable with said rails for slidably removable retention of said cover over said feed spring and feed plate assembly opening, lock stop means formed on at least one outer side wall of said main body adjacent at least one of said rails, and lock lip means formed on at least one of said slide/retention lips and engagable with said lock stop means to lock said cover in place, said one outer side wall being manually elastically flexible to an extent to enable depression of said lock stop means to a laterally inward position out of locking relation with said lock lip means, said lock stop means comprising a cam lock stop on said one outer side wall, and an end stop spaced from said cam lock stop, said lock lip means being retainably engagable with both of said cam lock stop and said end stop and being disposed in retained relation between said cam lock stop and said end stop when said bottom cover is in fully assembled covering relation on said other feed spring and feed plate assembly opening end, and said lock lip means being movable over said cam lock stop by depression of said one outer side wall during assembly and removal of said cover, said depression being by cam interaction during assembly and by positive manual depression during removal.

4. A cartridge magazine according to claim 3, said lock stop means being cam lock stop means having a cam entry portion engagable by said lock lip means to enable ease of slide locking of said cover into place on said rails, and a shoulder lock stop retention portion to lock said lock lip means in place after sliding over said cam entry portion.

5. A cartridge magazine according to claim 4, said lock stop means and said lock lip means comprising respective lock stop means and lock lip means on opposite respective sides of said main body and said cover, and both associated outer side walls of said main cover being manually elastically flexible to an extent to enable depression of the respective said lock stop means to a laterally inward position out of locking relation with the respective said lock stop means.

* * * * *